US010143342B2

(12) United States Patent
Rawová et al.

(10) Patent No.: US 10,143,342 B2
(45) Date of Patent: Dec. 4, 2018

(54) SANITARY SET

(71) Applicant: Naděžda Rawová, Praha (CZ)

(72) Inventors: Naděžda Rawová, Prague (CZ); Hynek Pakosta, Prague (CZ)

(73) Assignee: RAWA DESIGN S.R.O., Prague (CZ)

( * ) Notice: Subject to any disclaimer, the term of this patent is extended or adjusted under 35 U.S.C. 154(b) by 212 days.

(21) Appl. No.: 14/409,247

(22) PCT Filed: Feb. 21, 2013

(86) PCT No.: PCT/CZ2013/000020

§ 371 (c)(1),
(2) Date: Dec. 18, 2014

(87) PCT Pub. No.: WO2013/189469

PCT Pub. Date: Dec. 27, 2013

(65) Prior Publication Data

US 2015/0190019 A1 Jul. 9, 2015

(30) Foreign Application Priority Data

Jun. 18, 2012 (CZ) ..... PUV2012-26237

(51) Int. Cl.
*A47K 13/12* (2006.01)
*A47K 13/26* (2006.01)
*E05D 1/06* (2006.01)

(52) U.S. Cl.
CPC ..... *A47K 13/26* (2013.01); *A47K 13/12* (2013.01); *E05D 1/06* (2013.01); *E05Y 2201/46* (2013.01); *E05Y 2900/614* (2013.01)

(58) Field of Classification Search
CPC ..... A47K 13/26; A47K 13/12
USPC ..... 4/236, 240, 246.1, 242.1
See application file for complete search history.

(56) References Cited

U.S. PATENT DOCUMENTS 4,561,130 A 12/1985 Bumgardner
7,817,006 B2 * 10/2010 Fullerton ..... F41G 11/001 335/285
2008/0169708 A1 * 7/2008 Shibata ..... G03B 27/58 310/12.06

(Continued)

FOREIGN PATENT DOCUMENTS

FR 2 915 667 A1 11/2008
JP 2011 167238 A 9/2011
WO WO 2008/065272 A1 6/2008

OTHER PUBLICATIONS

International Preliminary Report on Patentability and Written Opinion in corresponding PCT Application No. PCT/CZ2013/000020, dated Dec. 23, 2014.

(Continued)

*Primary Examiner* — Christine Skubinna
(74) *Attorney, Agent, or Firm* — Leason Ellis LLP

(57) ABSTRACT

Sanitary set consist of the toilet seat (2), the lid (1) on the toilet bowl (3) where the toilet seat (2) and the lid (1) are connected to the upper edge of toilet bowl (3) by means of rolling joints around the horizontal axis characterized in that the rolling joints are formed from magnets (5.1, 5.2) arranged on or in a horizontal bar (5) in rear end of upper plane of toilet bowl (3) and oppositely polarized magnets (6) in rear end of the toilet seat (2) and oppositely polarized magnets (7) in the rear end of the lid (1).

6 Claims, 14 Drawing Sheets

(56) References Cited

U.S. PATENT DOCUMENTS

2009/0064402 A1* 3/2009 Mauduit ..... A47K 13/26
4/236

OTHER PUBLICATIONS

International Search Report in corresponding PCT Application No. PCT/CZ2013/000020, dated May 12, 2013.

* cited by examiner

FIG. 2A
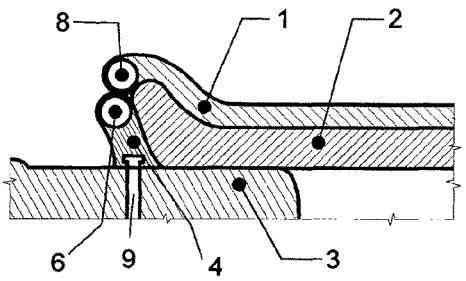
FIG. 2E
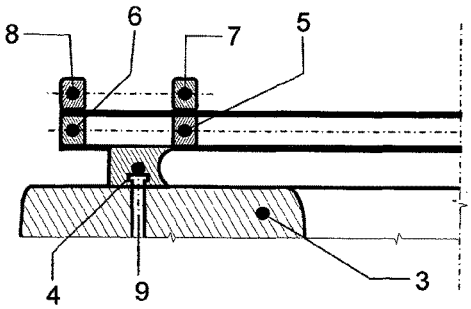
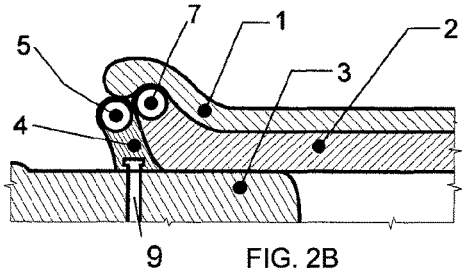
FIG. 2B
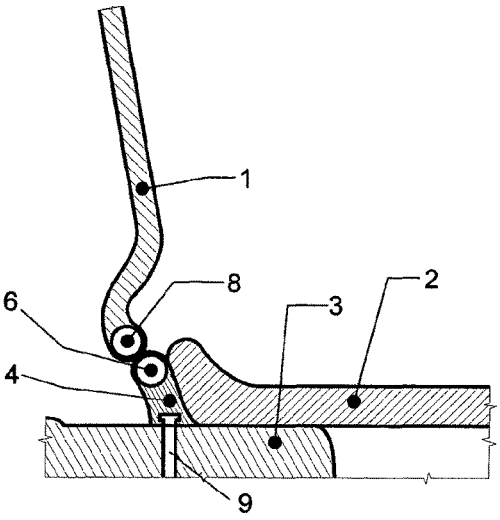
FIG. 2C
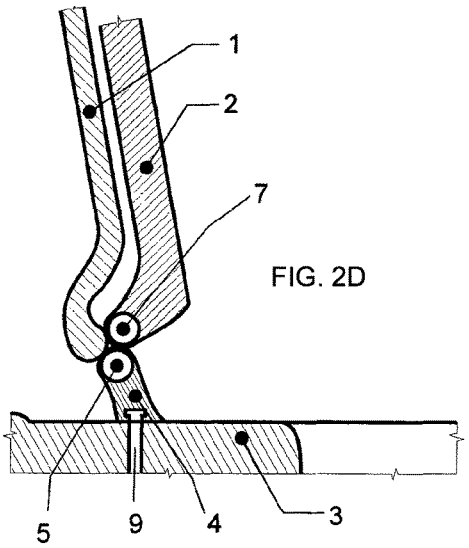
FIG. 2D FIG. 3A
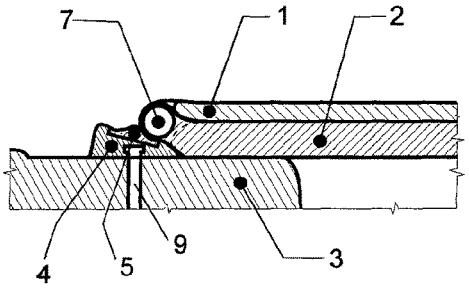
FIG. 3E
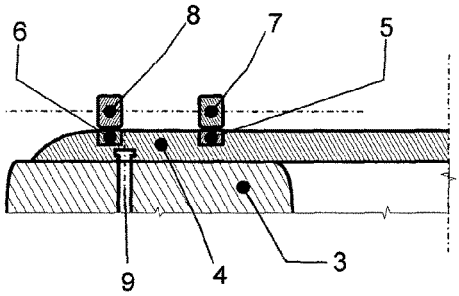
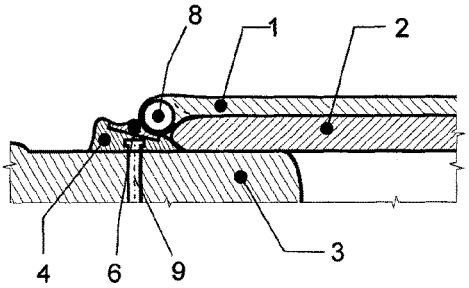
FIG. 3B
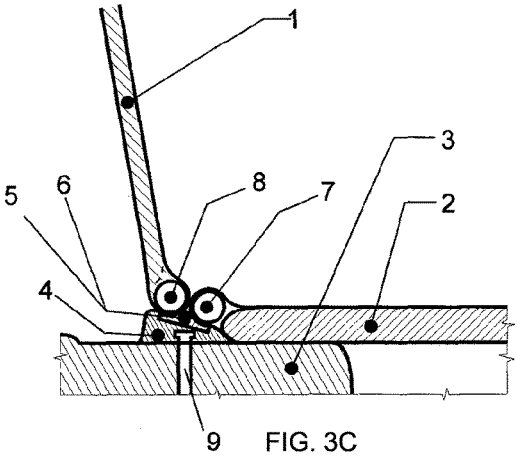
FIG. 3C
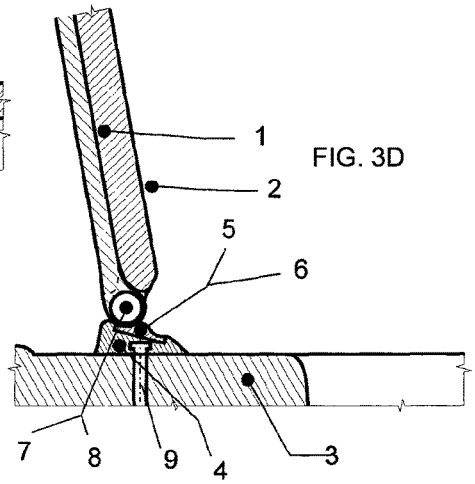
FIG. 3D FIG. 4A
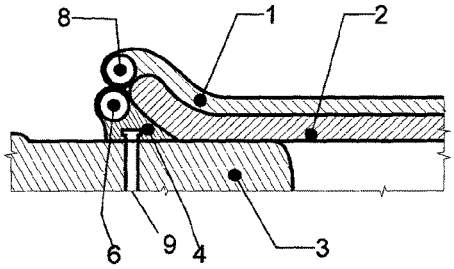
FIG. 4E
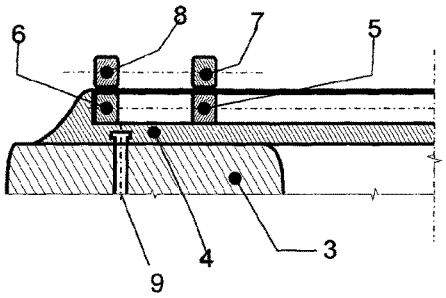
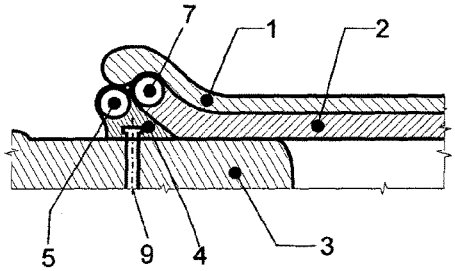
FIG. 4B
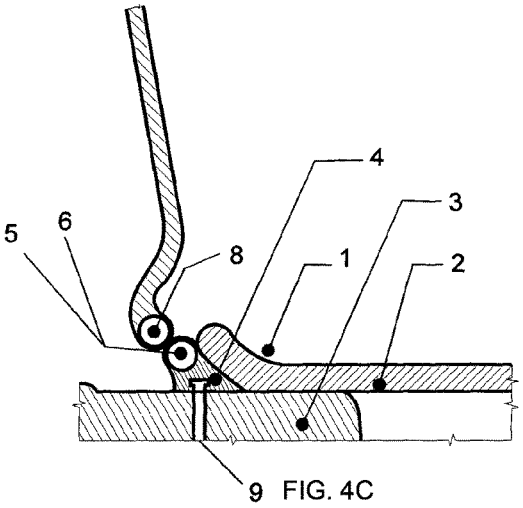
FIG. 4C
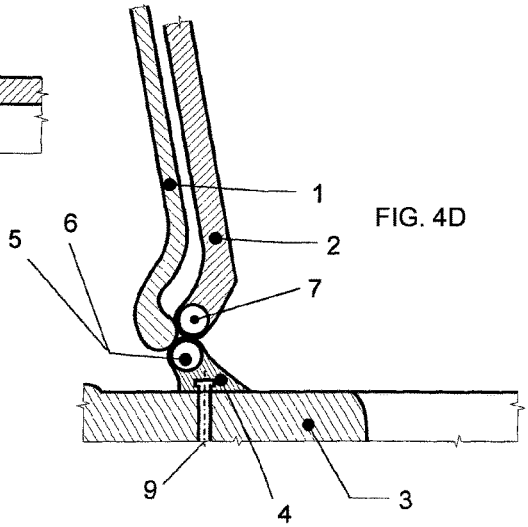
FIG. 4D

SANITARY SET

CROSS-REFERENCE TO RELATED PATENT APPLICATIONS

This application is a U.S. National Phase Application under 35 U.S.C. § 371 of International Patent Application No. PCT/CZ2013/000020, filed Feb. 21, 2013, and claims the priority to PUV 2012-26237, filed Jun. 18, 2012, all of which are incorporated by reference in their entireties. The International Application was published on Dec. 27, 2013 as International Publication No. WO 2013/189469 A2.

FIELD OF THE INVENTION

The technical concept involves a sanitary set that consists of a toilet seat and a lid placed on the toilet bowl where the toilet seat and toilet lid are connected to the upper part of a toilet bowl by means of rotary joints around the horizontal axis.

BACKGROUND OF THE INVENTION

Currently known from background arts and commonly used way to connect parts of a sanitary set (namely the toilet seat, the lid and a toilet bowl) is to connect parts by means of hinges. Hinges are fixed in its position by screws coming through the holes in the horizontal part of the toilet bowl. The lid and the toilet seat can be raised from or lowered towards the toilet bowl by the means of these hinges.

This system doesn't allow the lid and the toilet seat to be removed from and attached back to the toilet bowl, for example in the case of cleaning the sanitary set. Scale and dirtiness settle easily on the setup consisting of hinges, fixation screws, covers and female screws as the sanitary set is being used, which after some time can limit the functionality of the system of hinges, i.e. it can be impossible to disassemble the lid or the toilet seat from the toilet bowl, when the lid or the toilet seat needs to be replaced. Above all this system of fixation of the parts of the sanitary set doesn't allow for easy and hygienically perfect maintenance. The system known from the background arts contains many inner spaces and gaps that cannot be cleaned during the common maintenance process.

The aim of presented invention is therefore to find such way of connecting the parts of sanitary set consisting of the toilet seat, the lid and the toilet bowl, without the need for permanent fixation by means of hinges in order to provide the possibility to easily remove the toilet seat and the lid separately from the toilet bowl and to attach above mentioned parts back to previously allotted position on the toilet bowl by mere movement of the part further from the bowl or movement closer to the bowl.

DISCLOSURE OF THE INVENTION

The above mentioned aim and the deficiencies from background arts are to some extent solved by the sanitary set, consisting of the toilet seat and the lid on the toilet bowl, where the toilet seat and the lid are connected to the upper edge of toilet bowl by means of rolling joints around the horizontal axis where in presented invention rolling joints are made of magnets arranged on or in the horizontal bar on the rear edge of the toilet bowl and contrary polarized magnets in the rear edge of the lid and contrary polarized magnets in the rear edge of the toilet seats, while the magnets create the rolling joint among the connected parts.

This presented solution uses the attracting force of magnetic rolling joint in all possible modification in order to allow the connected parts to be moved freely in the range of efficient rolling surfaces without the danger of spontaneous separation of the connected parts.

Especially simple and cost efficient possibility of technical solution is to use permanent magnets as magnets.

In special cases, where for example there is a need for the remote control of rolling joints, it can be suitable to use electromagnets as magnets.

From technical construction perspective it is suitable that magnets are arranged in the bar constituted from the tube from nonmagnetic material.

The bar can be fixed on the upper edge of the toilet bowl by means of fixtures and fixing components that go through the holes in the toilet bowl. Above mentioned fixing components, in most cases screws can go through the vertical assembly holes in rear edge of ordinary toilet bowl.

There is also a complex design solution in which the bar is completely integrated in the upper part of newly designed toilet bowl.

It is possible to substantially increase the attracting force of the magnets by technical solution in which at least one magnet is composed from partial magnets. These partial magnets are arranged towards each other with changing magnetic polarity N, S in axial direction, in other word the partial magnets are fitted toward each other by repulsing magnetic poles. It is advantageous to insert ferromagnetic insets between partial magnets described above.

Finally, the presented invention includes the solution, where the rolling joints connecting individual parts of the sanitary sets are constructed as general rolling surfaces or as sectors of these general rolling surfaces. Mutual attracting magnetic force is therefore variable as the parts are rotated. At a given moment of the rotation movement, individual parts of the sanitary set are connected together by magnetic force acting in the radial direction that is perpendicular to the plane of the connection as well as in the axial direction that is parallel to the plane of connection. When general rolling surface is used at least on one part of the sanitary set, the tangential action of magnetic force is added to the radial and axial magnetic force action, while this tangential magnetic force shoes its minimums and maximums according to the topology of the general rolling surface. By shaping of the general rolling surfaces it is possible to achieve any desired development of the magnetic force during the rotation.

BRIEF DESCRIPTION OF DRAWING

The object of the presented invention is consequently clarified on the examples of its embodiment that are described on the basis of attached drawing that represent:

FIGS. 2A-2D: The second embodiment of the sanitary set for common toilet bowls in side view of different positions of the toilet seat and the lid and lateral cross section view of the area of connection.

FIGS. 3A-3D: The third embodiment of the sanitary set for common toilet bowls in side view of different positions of the toilet seat and the lid and lateral cross section view of the area of connection.

FIGS. 4A-4D: The fourth embodiment of the sanitary set for common toilet bowls in side view of different positions of the toilet seat and the lid and lateral cross section view of the area of connection.

DESCRIPTION OF THE BEST MODE OF THE INVENTION

Figure 1A:
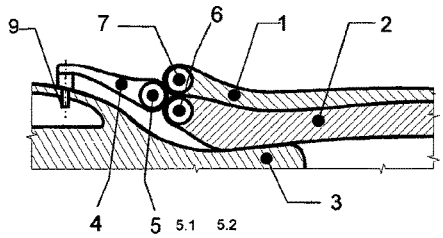
FIGS. 1A-1D: The first embodiment of the sanitary set for common toilet bowls in side view of different positions of the toilet seat and the lid.
Figure 1B:
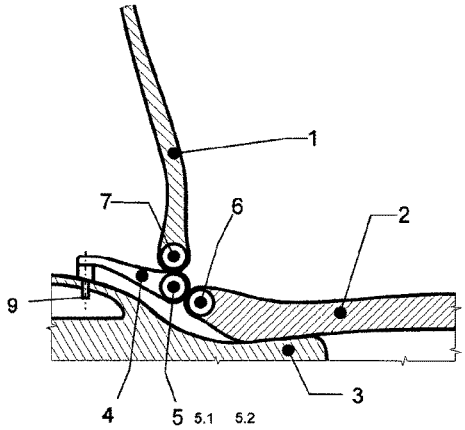
Figure 1D:
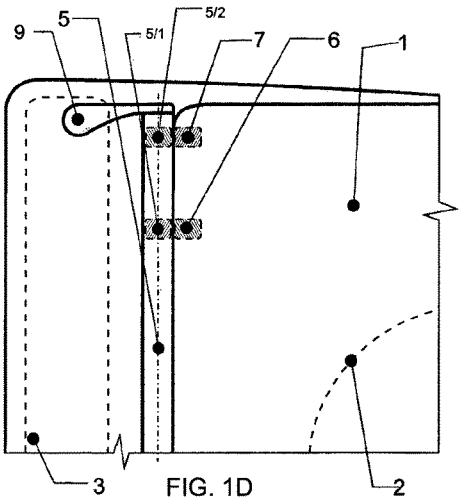
Figure 1C:
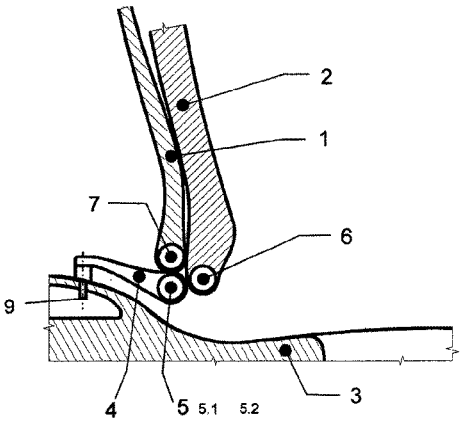

The sanitary set according to the first embodiment of the invention that is showed in FIGS. 1A-1D is adjusted on the common toilet bowl 3, by the common toilet bowl is meant such toilet bowl that is equipped with vertical holes 9 in the rear edge of the bowl and positioned approximately in the plane of the sanitary set, vertical holes are used for inserting mounting members, such as screws, in order to mount the sanitary set to the bowl. This sanitary set consists of the toilet seat 2 and the lid 1. which in FIG. 1A is laying one on another and on the toilet bowl 3. The toilet seat 2 and the lid 1 can be lifted from the toilet bowl 3 as shown in the FIGS. 1B or 1C. Novelty of this solution lies in the design of the revolving mounting of the toilet seat 2 and the lid 1 in relation to the toilet bowl 3. Above the rear upper edge of the toilet bowl 3 the horizontal bar 5 is mounted by means of above mentioned mounting members 9 that constitutes of the tube made of nonmagnetic material, in which the first magnets 5.1, 5.2 are arranged. The rear edges of the toilet seat 2 and the lid 1, in which the second magnets 6 are arranged in appropriate placement, are rolling on the outer perimeter of the horizontal bar 5.

The sanitary set according to the second embodiment of the invention that is showed in FIGS. 2A-2D differs from the first embodiment by raised fixture 4 of the bar 5.

The sanitary set according to the third embodiment of the invention that is showed in FIGS. 3A-3D differs from previous embodiments by the fixture 4 that is formed in the shape of flat slat that has the bar 5 integrated in its upper side and consists of first magnets 5.1 and 5.2 and having double channels in which the second magnets 6 of the toilet seat 2 respectively the third magnets 7 of the lid 1 are rolling.

The sanitary set according to the fourth embodiment of the invention that is shown in FIGS. 4A-4D is designated to be used with common toilet bowl 3, differs from the previous embodiments by the bar 5 that is in positioned further back on the toilet bowl 3.

Figure 5A:
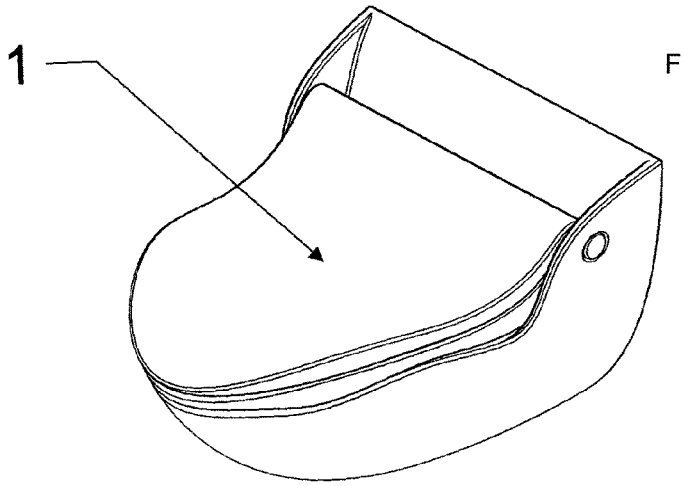
FIGS. 5A-5C: Axonometric views of the embodiment of the special toilet bowl with the lid and the toilet seat in different positions and the view without the lid and the toilet seat.
Figure 5B:
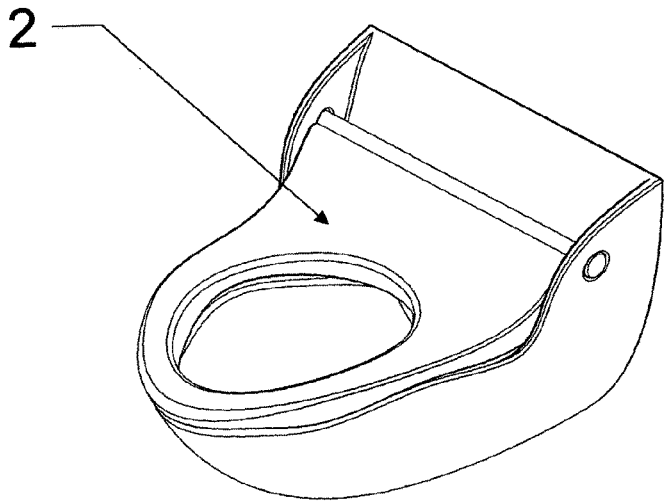
Figure 5C:
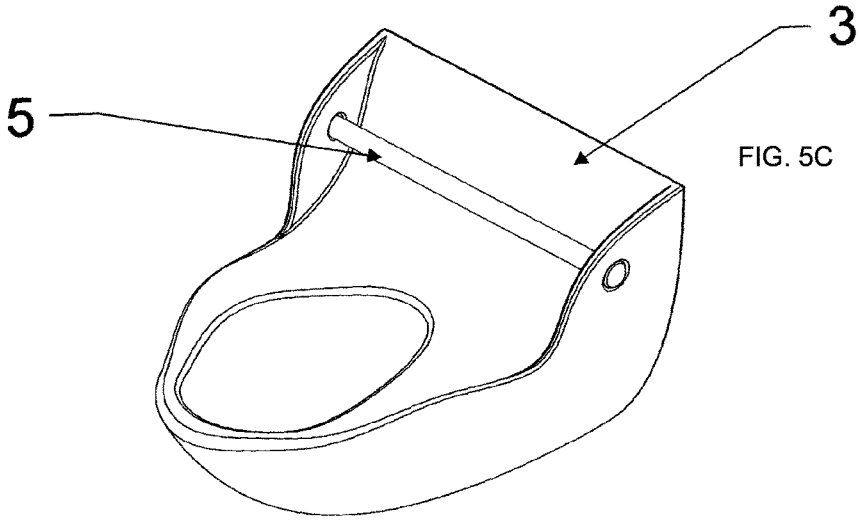

In FIGS. 5A-5C there are different axonometric views on the fundamental embodiment of the special toilet bowl 3 with the toilet seat 2 and the lid 1 of the sanitary set shown in different positions and without the lid 1 and the toilet seat 2. The bar 5 is in this case directly integrated in the toilet bowl 3.

Figure 6A:
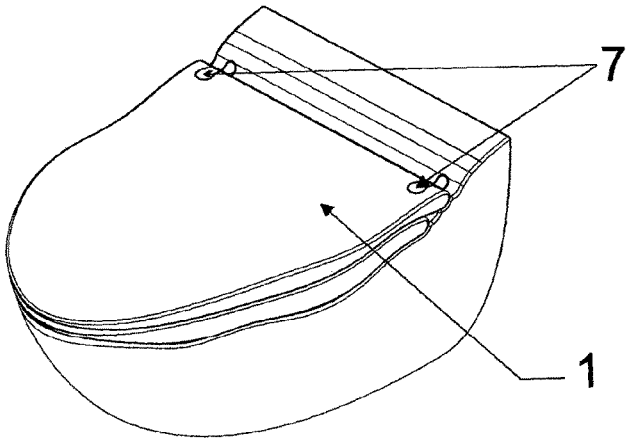
FIGS. 6A-6C: Axonometric views of the first embodiment of the special toilet bowl with the lid and the toilet seat in different positions
Figure 6B:
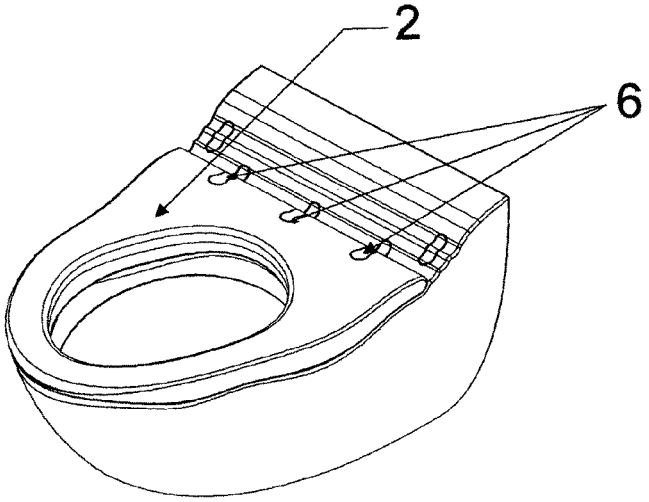
Figure 6C:
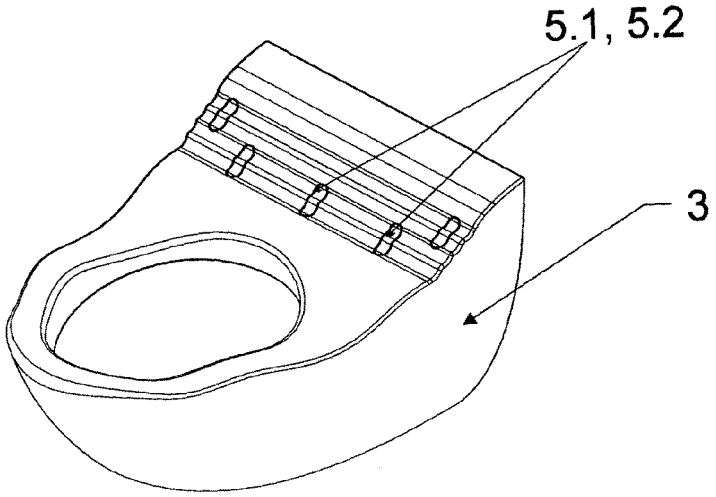
Figure 7A:
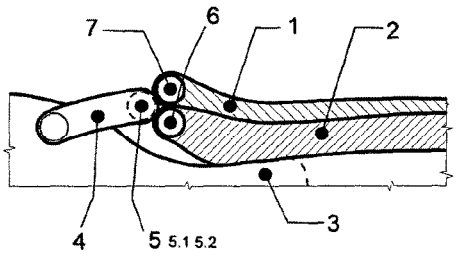
FIGS. 7A-7D: Side cross section views of the second embodiment of the sanitary set for a special toilet bowl and a horizontal projection view of the set.
Figure 7B:
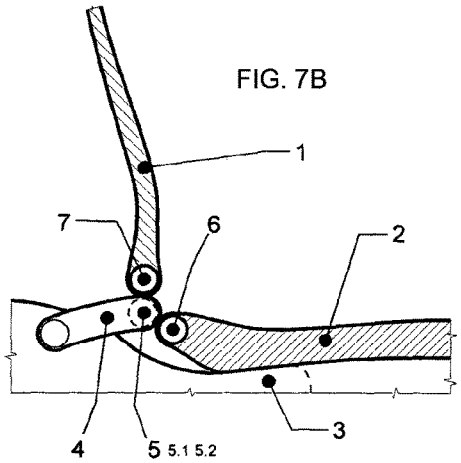
Figure 7C:
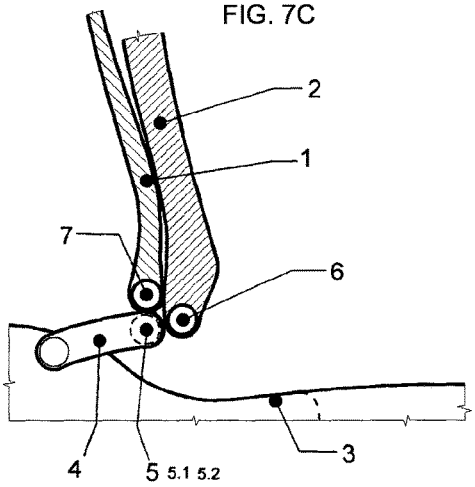
Figure 7D:
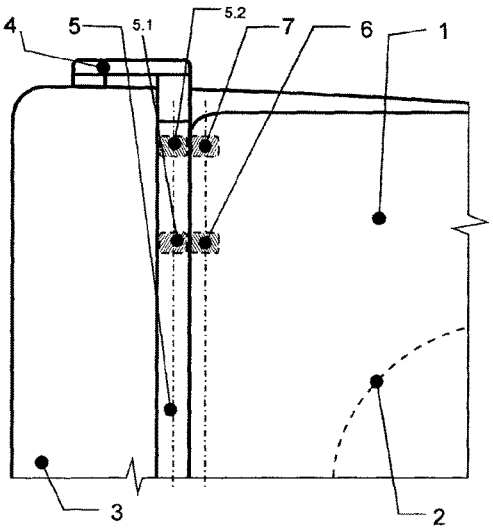
Figure 8A:
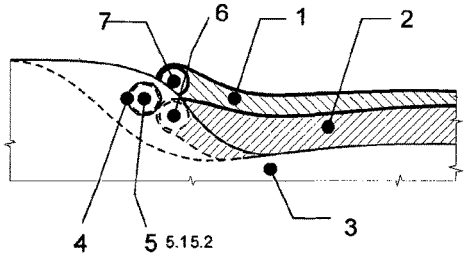
FIGS. 8A-8D: Side cross section views of the third embodiment of the sanitary set for a special toilet bowl and a horizontal projection view of the set.
Figure 8B:
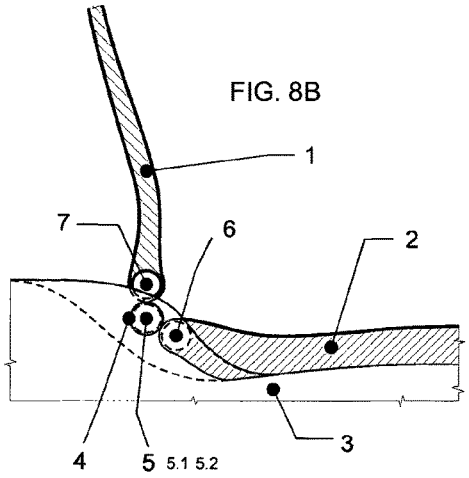
Figure 8C:
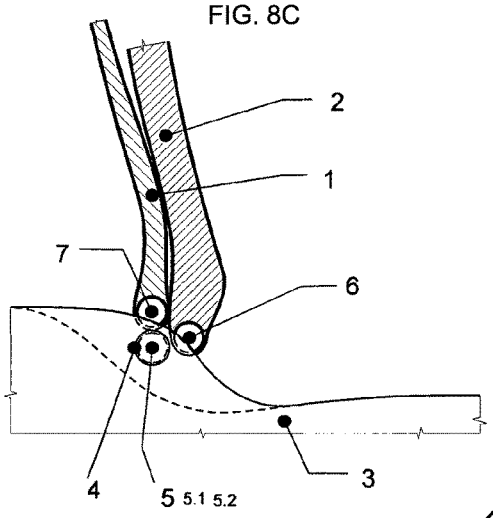
Figure 8D:
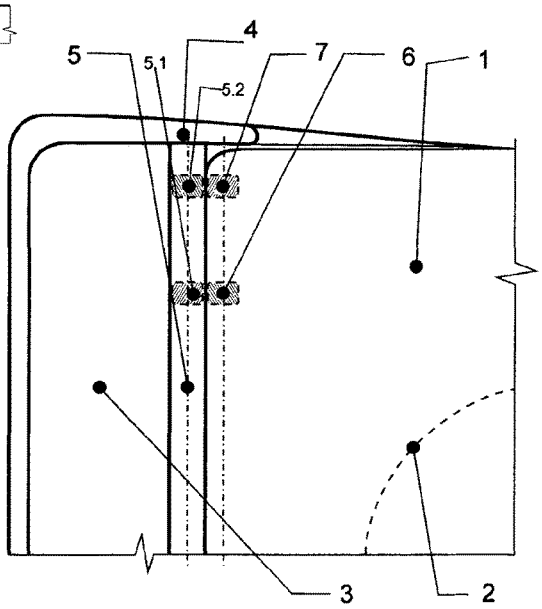
Figure 9A:
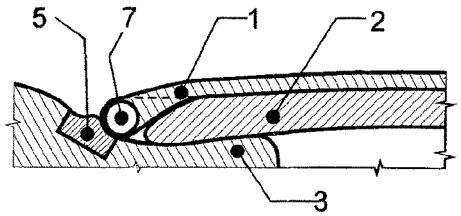
FIGS. 9A-9D: Side cross section views of the fourth embodiment of the sanitary set for a special toilet bowl in different positions of the parts of sanitary set and in different planes of section
Figure 9B:
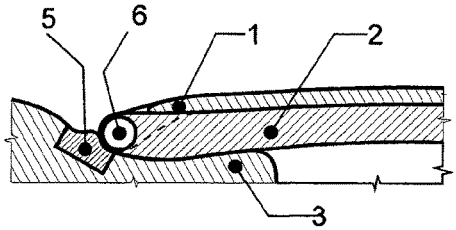
Figure 9C:
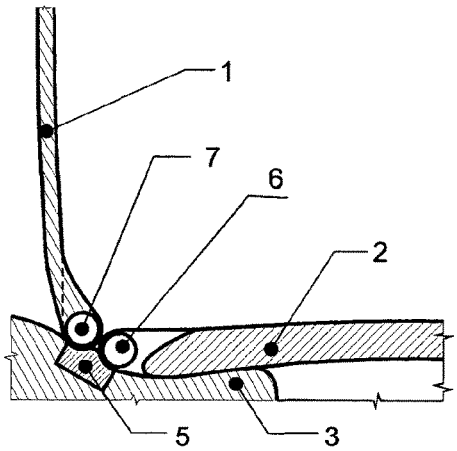
Figure 9D:
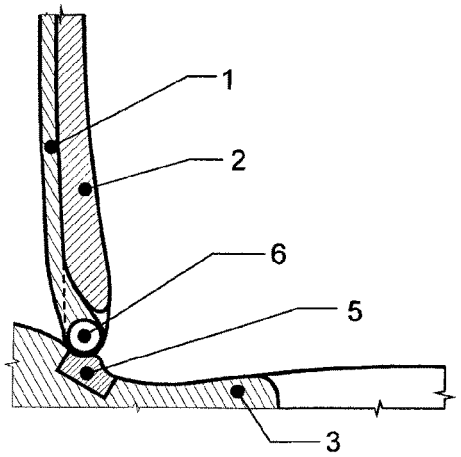

In FIGS. 6A-6C there are axonometric side views on the first embodiment of the sanitary set for the special toilet bowl 3. Contrary to FIGS. 5A-5C, the magnets 5.1, 5.2, 6 and 7 for connecting the bar 5 (explicitly invisible in the figures) with the toilet seat 2 and the lid 1.

In FIGS. 7A-7D there are side cross section views of the second embodiment of the sanitary set for the special toilet bowl 3 and the horizontal projection view of this configuration. Contrary to the previous embodiments the bar 5 is not directly connected to the toilet bowl 3, but it is moved forward on the toilet bowl 3 by means of pair of fixtures 4.

In FIGS. 8A-8D there are side cross section views of the third embodiment of the sanitary set for the special toilet bowl 3 and the horizontal projection view of this configuration. Contrary to FIGS. 7A-7D, the fixture 4 of the bar 5 is integrated in the toilet bowl 3.

In FIGS. 9A-9D there are side cross section views of the fourth embodiment of the sanitary set for the special toilet bowl 3 in different positions of the parts of sanitary set and different cross section views. The bar 5 has in this embodiment the form of flat slat built in the toilet bowl 3.

Figure 10A:
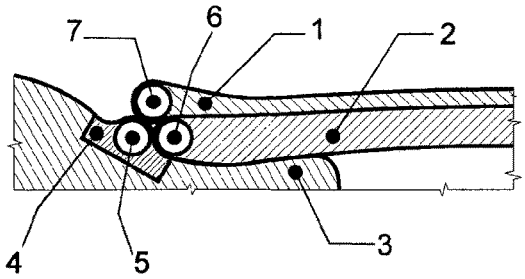
FIGS. 10A-10C: Side cross section views of the fifth embodiment of the sanitary set for a special toilet bowl in different positions of the parts of sanitary set
Figure 10B:
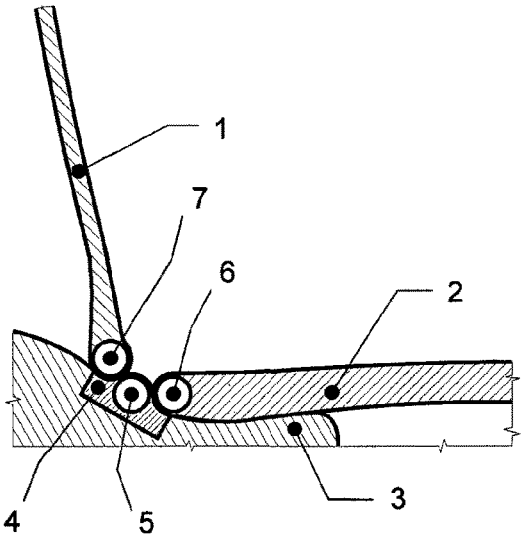
Figure 10C:
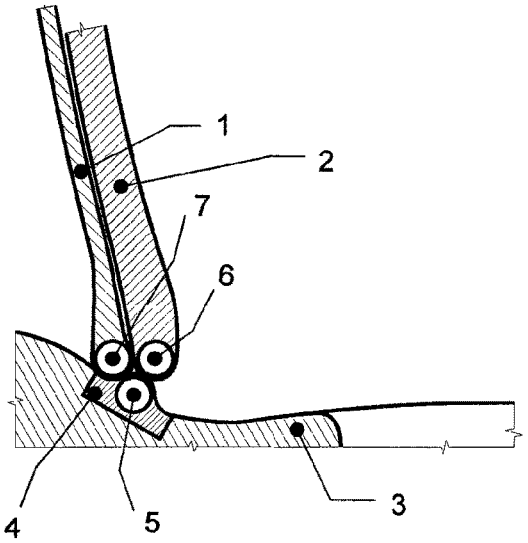

In FIGS. 10A-10C there are side cross section views of the fifth embodiment of the sanitary set for the special toilet bowl 3 in different positions of the parts of sanitary set. The bar 5 is in this embodiment partly imbedded in the fixture 4 that is integrated in the toilet bowl 3. On the upper side of the fixture 4 longitudinal depressions along the sides of the bar 5 are formed in which the rear edges of the lid 1 and the toilet seat 2 fit.

Figure 11A:
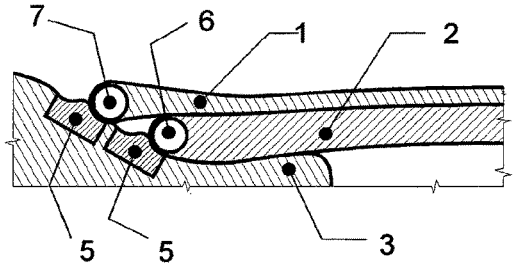
FIGS. 11A-11C: Side cross section views of the sixth embodiment of the sanitary set for a special toilet bowl in different positions of the parts of sanitary set
Figure 11B:
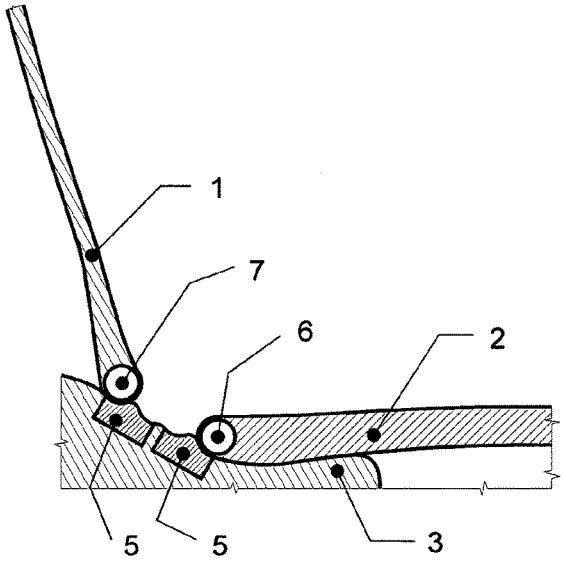
Figure 11C:
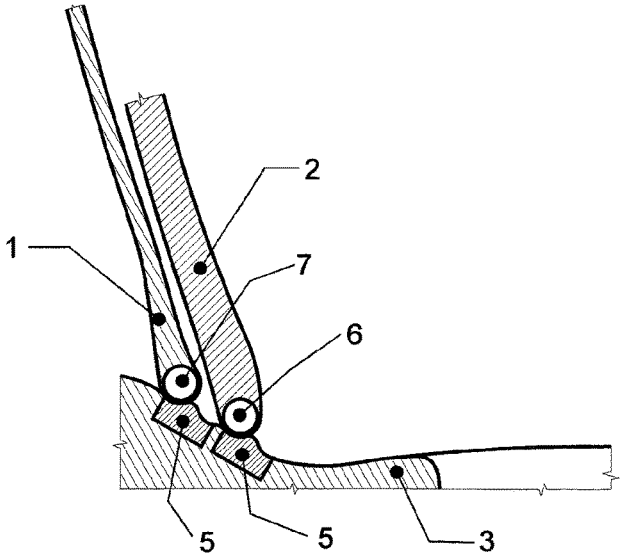

In FIGS. 11A-11C there are side cross section views of the sixth embodiment of the sanitary set for the special toilet bowl 3 in different positions of the parts of the sanitary set. The bar 5 is shaped as a pair of parallel flat slats that are imbedded in the toilet bowl 3. The lid 1 and the toilet seat 2 are each connected to its own bar 5 and their rear edges and are revolving on these bars 5.

Figure 12:
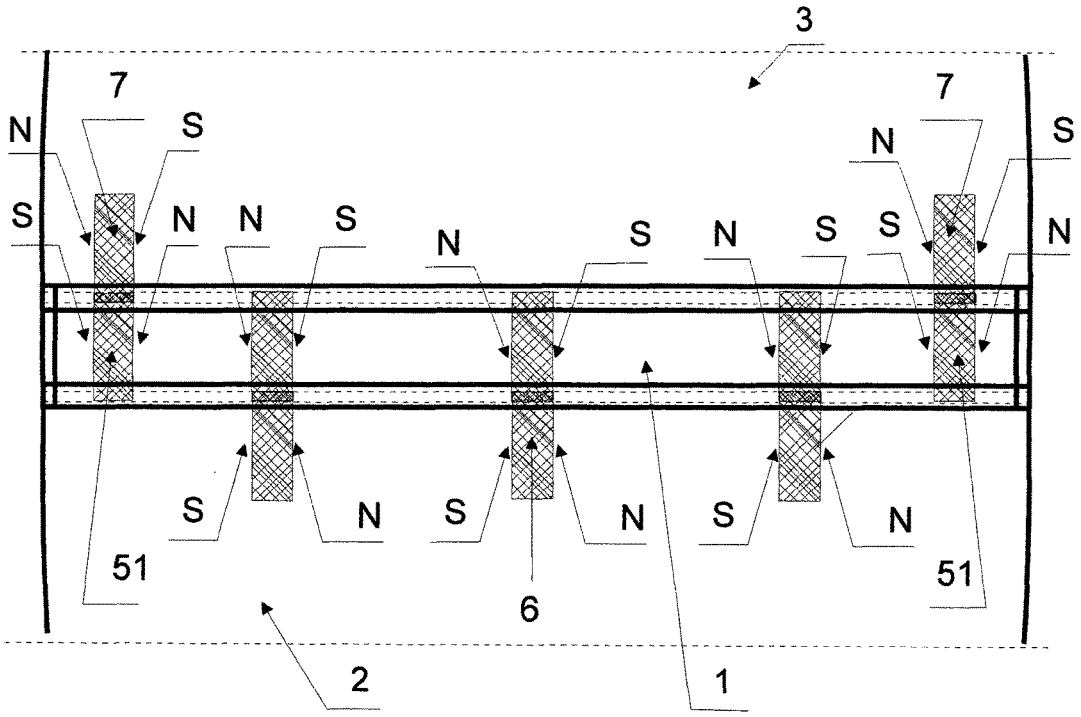
FIG. 12: Schematic section view of the magnet arrangement in the bar, the lid and the toilet seat

In FIG. 12 there is the schematic section view of magnet 5.1, 5.2, 7, 6 arrangement in the bar 5, the lid 1 and the toilet seat 2. Apparently, the poles N,S, of the magnets 5.1, 5.2, in the bar 5 are arranged oppositely toward the S, N poles of the magnets 7 of the lid 1 and the magnets 6 of the toilet seat 2.

Figure 13:
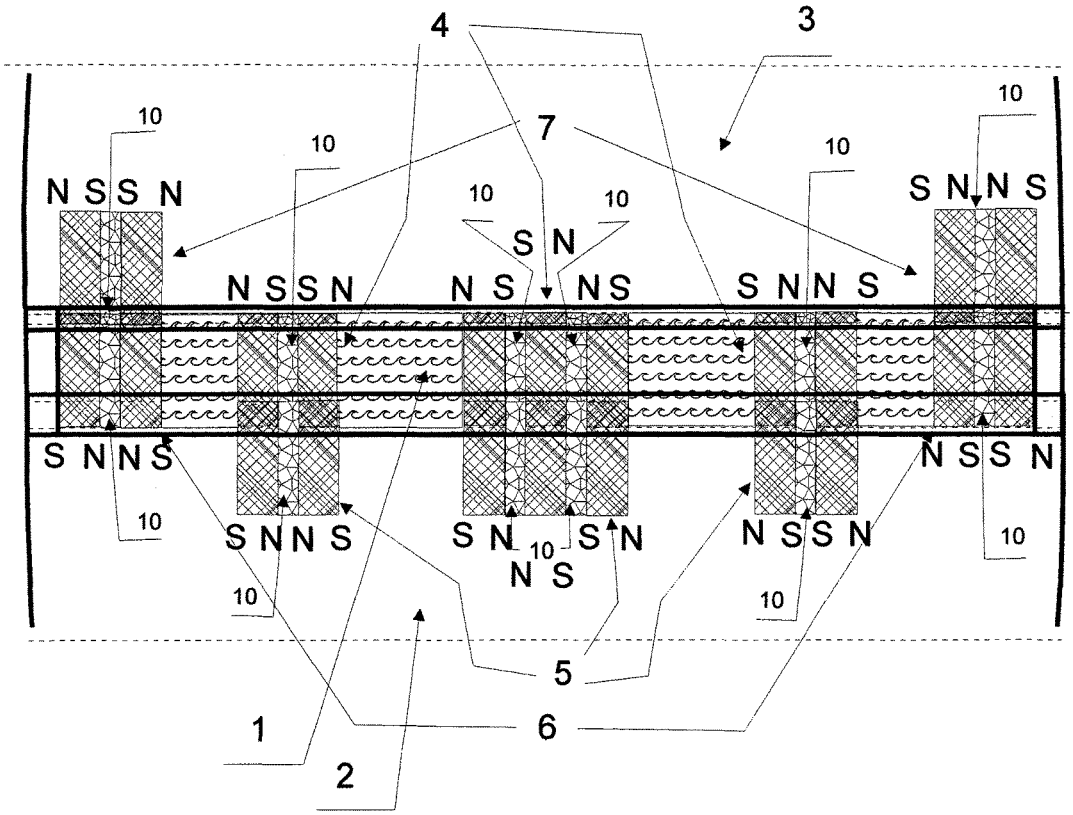
FIG. 13: Schematic section view of another magnet arrangement in the bar, the lid and the toilet seat

In FIG. 13 there is the schematic section view of different magnet 5.1, 5.2, 7, 6 arrangement in the bar 5, the lid 1 and the toilet seat 2. Each magnet 5.1, 5.2, 7, 6 consists of at least two partial magnets that are arranged towards each other axially, directly or indirectly through the ferromagnetic inset 10, by accordant magnetic poles. In the case of the triplet of magnets as shown in the middle of the fig. magnets are arranged by polarity in pattern NS-SN-NS or vice versa.

Figure 14:
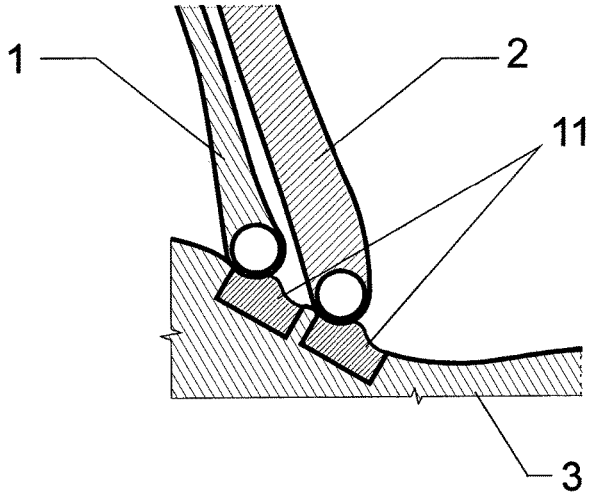
FIG. 14: Side cross section view of the embodiment of invention that uses general rolling surfaces

In FIG. 14 there is side section view of the seventh embodiment of sanitary set that implements the general rolling surface 11 on at least one part, i.e. on the toilet seat 2, the lid 1 or the toilet bowl 3, in order to achieve the tangential acting of magnetic force during the movement of the parts.

The sanitary set according to the presented invention solves mutual connection of three parts of the set: the toilet seat 2, the lid 1, the toilet bowl 3 without the need for permanent mounting and uses the attracting magnetic force acting in sets of magnetic rolling joints in the way that the toilet seat 2 in which the second magnet 6 is inserted is connected to the horizontal part of toilet bowl 3 in which the first magnet 5.1, 5.2 is inserted into the integrated bar 5. The lid 1 in which the third magnet 7 is inserted is connected to the horizontal part of the toilet bowl 3 in which the first magnet 5.1, 5.2 is inserted into the integrated bar 5.

Above mentioned technical solution solves mutual connecting of three mentioned parts in case of common toilet bowl 3, that being the bowl 3 with the vertical holes 9 for mounting members, such as screws, and newly designed toilet seat 2 and the lid 1, as well as it solves the connecting the parts of newly designed sanitary set, where all three parts are new. In this case the horizontal plane of the bowl 3 is designed in the way that it supports and enhances the functionality of the set. In the case of special toilet bowl 3 magnets 5.1, 5.2 of the toilet bowl 3 are arranged in a special component, such as the fixture 4 that is fixed to the toilet bowl 3 by screws.

The sanitary set according to the presented invention includes the technical solution, where the means of rolling magnetic joints of the toilet bowl 3, such as magnets 5.1, 5.2, are firmly integrated to horizontal part of toilet bowl 3 in such way that they form the shape of the horizontal surface that in the place where magnets 5.1, 5.2 forms the rolling surface of the joints. The second possible solution is the embodiment, where magnets 5.1, 5.2 of the toilet bowl 3 are integrated to the surface of the toilet bowl 3 that is formed from for example from round tube. This tube is integral part of the toilet bowl 3 and forms the rolling surface and is positioned and fixated to the toilet bowl 3 on the upper horizontal part of the bowl.

The toilet seat 2 as well as the lid 1 has the according magnets 6,7, of the joint integrated in the rear end of the toilet seat 2 or the lid 1 respectively. The material of these parts creates the surface of the magnets 6,7, and forms the rolling surfaces of the joints. In the figs and the description above, there are several possibilities of the arrangement of the magnets 6,7,5.1,5.2 described.

The rolling surfaces of the magnets in magnetic joints can be formed as cylindrical rolling surfaces or general rolling surfaces 11. Effective rolling surface can also be formed as a sector of the general rolling surface 11. Mutual attracting magnetic force is therefore variable as the parts are rotated. At a given moment of the rotation movement, individual parts of the sanitary set, namely the lid 1, the toilet seat 2 and the toilet bowl 3 are connected together by magnetic force acting in the radial direction that is perpendicular to the plane of the connection as well as in the axial direction, that is parallel to the plane of connection. When general rolling surface 11 is used at least on one part of the sanitary set, the tangential action of magnetic force is added to the radial and axial magnetic force action, while this tangential magnetic force shows its minimums and maximums according to the topology of the general rolling surface 11. By shaping of the general rolling surfaces 11 it is possible to achieve any desired development of the magnetic force during the rotation.

The presented invention takes in account that at least one from the pair of the related components in the magnetic joint must be from magnetic active material, such as permanent magnet or electromagnet.

The second component from the pair of components creating the magnetic joint can also be formed from magnetic active material such as permanent magnet of electromagnet, or it can be formed from magnetic reactive material, such as ferromagnetic steel or another material that can be attracted by magnetic force. The second solution mentioned above can be suitable regarding the manufacturing costs of the sanitary set.

Both related components in the magnetic joint are positioned toward each other in precisely defined positions. The ferromagnetic insets can be placed at the sides of magnets in the magnetic joints to alter the magnetic field and the strength of the magnetic joints. When both components in magnetic joints are made of permanent magnets, magnets are situated toward each other in axial direction in opposite polarization.

It is possible to substantially increase the attracting force of the magnets in joints by technical solution shown in FIG. 13, in which at least one magnet of the joint is composed from partial magnets These partial magnets are arranged towards each other with changing magnetic polarity N,S in axial direction, in other word the partial magnets are fitted toward each other by repulsing magnetic poles. It is advantageous to insert ferromagnetic insets between partial magnets described above.

When it is desirable to increase the attracting force in the joints it is possible to use the specific type of magnetic rolling joint according to the FIG. 13. where at least one magnet from the pair of the related components in the magnetic joint consists of arrangement of partial magnets. These partial magnets are arranged towards each other with changing magnetic polarity N,S in axial direction, in other word the partial magnets are fitted toward each other by repulsing magnetic poles. It is advantageous to insert ferromagnetic insets 10 between partial magnets and on each edge of magnet arrangement described above. Partial magnets and insets 10 are fixed in geometrically precise position toward each other regardless the repulsive force that is acting among these partial magnets. The presented invention takes in account that at least one magnet from the pair of related components in magnetic joint can be formed from arrangement of at least two partial magnets, however, when it is desirable, the both related magnet from the pair can be replaced by the above described arrangement.

The research and experiments that were conducted in regard to the presented invention have shown, that the magnetic joints made up only from simple magnets, or arrangements of partial magnets that are attracting each other are not efficient from the view of magnetic force. The best technical solution regarding the magnetic force optimization is to use the arrangements of partial magnets. There are at least two partial magnets that are orientated towards each other with changing magnetic polarity N,S in axial direction, in other word the partial magnets are fitted toward each other by repulsing magnetic poles and for the best results, there is a ferromagnetic inset 10 fitted between the pair of repulsing partial magnets. In theory the magnetic field is forced above the ferromagnetic inset 10 to form the best and strongest magnetic interaction with other component in the magnetic rolling joint when the above described solution is used. Experiments using different distances between the pair of components forming the joint and using different thickness of ferromagnetic insets 10 were carried out. The thickness of ferromagnetic insets was selected from the range 0 mm to 8.3 mm. When the distance between the two components of the magnetic rolling joint is 2.5 mm, the magnetic attracting force is nearly of the same strength for ferromagnetic insets of thickness 3-8 mm. Whereas the mutual magnetic attracting force and its strength among two parts of magnetic joint is made as a combination of magnetic induction in the space between the parts and the area of magnetic action, the final strength of the joint is to some extent independent on the thickness of ferromagnetic insets 10 used. However, the best mode of the invention, where the magnetic strength of the joint is optimal regarding strength/cost ratio, is when ferromagnetic insets 10 of thickness 5 mm and more are used between a pair of partial magnets in at least one component from the pair that constitutes a magnetic rolling joint.

Sanitary set according to the presented invention bring several major advantages to commonly known technical solutions:

The toilet seat 2 and the lid 1 can be removed from and attached back by mere movement apart and back in relation to the toilet bowl 3 without need for permanent assembly and this process can be repeated without causing any wear out. All parts of the set have simple and smooth surface allowing for easy and hygienically perfect maintenance. The toilet seat 2 and the lid 1 can be removed from the toilet bowl and can be cleaned and sterilized separately. The horizontal plane of the toilet bowl 3 is smooth and it can be maintenanced easily when the toilet seat 2 and the lid 1 are removed.

In some embodiments described above the lid land the toilet seat 2 is held in upright position by the maximum of the tangential magnetic force in the magnetic joint. This position in independent of any other backing and therefore the lid 1 or the toilet seat 2 doesn't have to lean against the wall or back side of the toilet set to sustain the upright position.

The rolling magnetic joint used in the presented sanitary set forms a strong, permanent and reusable connection among the parts and it works well in humid environments without any wear out or corrosion.

APPLICABILITY OF THE INVENTION

The sanitary set according to the presented invention can be applied in many situations. It can be used for any cases, where there is a need for new toilet facility with improved functionality or it can be used as an upgrade for current toilet facilities.

It can be used in household environments as well as in public or commercial spaces. The presented invention is particularly effective wherever it is highly important to sustain high level of sanitation of the toilet facilities and where the sanitary sets need to be cleaned frequently, simply and effectively. It is possible to clean and sterilize the lids 1 and the toilet seats 2 externally in sterilization boxes. The presented invention can be used well in regards with above mentioned features in hospitals, spa facilities, sport centers, gyms, retirement houses, hotels, etc. In public spaces, it is possible to use electromagnets in the magnetic joints to prevent undesired removal of the toilet seats 2 and lids 1.

The invention claimed is:

1. A sanitary set comprising:

a toilet seat and a lid connected to a toilet bowl, the toilet seat and the lid being connected to an upper edge of the toilet bowl by one or more rolling joints around a horizontal axis, wherein the one or more rolling joints are formed by a first group of one or more magnets arranged on or in a horizontal bar parallel to the horizontal axis in a rear end of an upper plane of the toilet bowl and in rolling contact with each of a first group of one or more oppositely polarized magnets arranged in a rear end of the toilet seat and a second group of one or more oppositely polarized magnets arranged in a rear end of the lid, wherein at least one of the first group of one or more magnets, the first group of one or more oppositely polarized magnets, or the second group of one or more oppositely polarized magnets includes an arrangement of alternating partial magnets in which the N-S magnetic polarity of each alternating partial magnet changes in the direction of the horizontal axis such that the repulsing magnetic poles of each alternating partial magnet are fitted toward each other, wherein a ferromagnetic insert is inserted between the partial magnets or is fitted at the sides of these magnets.

2. The sanitary set according to claim 1, wherein at least one of the magnets is a permanent magnet.

3. The sanitary set according to claim 1, wherein at least one of the magnets is an electromagnet.

4. The sanitary set according to claim 1, wherein the horizontal bar is an integral part of the upper plane of the toilet bowl.

5. The sanitary set according to claim 1, wherein at least one rolling joint of the set is constructed as a general rolling surface or a section thereof.

6. The sanitary set according to claim 2, wherein at least one rolling joint of the set is constructed as a general rolling surface or a section thereof.

* * * * *